US006859779B2

(12) United States Patent
Yokoyama

(10) Patent No.: US 6,859,779 B2
(45) Date of Patent: Feb. 22, 2005

(54) COMMUNICATION APPARATUS

(75) Inventor: Tohru Yokoyama, Kokubunji (JP)

(73) Assignee: Hitachi Ltd., Tokyo (JP)

( * ) Notice: Subject to any disclaimer, the term of this patent is extended or adjusted under 35 U.S.C. 154(b) by 580 days.

(21) Appl. No.: 09/793,747

(22) Filed: Feb. 27, 2001

(65) Prior Publication Data

US 2002/0072919 A1 Jun. 13, 2002

(30) Foreign Application Priority Data

Dec. 12, 2000 (JP) ..... 2000-383114

(51) Int. Cl.[7] ..... G10L 11/06
(52) U.S. Cl. ..... 704/278; 704/228; 704/227
(58) Field of Search ..... 704/233, 231, 704/235, 258, 215, 503, 255, 256; 348/589, 597; 714/747; 235/455, 600; 712/222; 382/103

(56) References Cited

U.S. PATENT DOCUMENTS 5,422,937 A * 6/1995 Ferrara ..... 379/67.1
5,867,815 A * 2/1999 Kondo et al. ..... 704/228
5,970,446 A * 10/1999 Goldberg et al. ..... 704/233
6,141,385 A * 10/2000 Yamaji ..... 375/240.27

FOREIGN PATENT DOCUMENTS

JP A-11-191796 * 7/1999
JP A-11-331379 * 11/1999

* cited by examiner

*Primary Examiner*—Susan McFadden
*Assistant Examiner*—Huyen X. Vo
(74) *Attorney, Agent, or Firm*—Antonelli, Terry, Stout & Kraus, LLP

(57) ABSTRACT

A background sound sending side multiplexes and sends, in a multiplexer, uttered encoded speech data generated in a speech sending section and encoded background sound data outputted from a background sound storing section. Simultaneously, a background sound reproducing section, reproduces encoded background sound data and reproduced background sound signal is superposed on received speech in a receiving section and outputted from a receiver. A background sound receiving side demultiplexes, in a demultiplexer, received multiplexed data into received encoded speech data and encoded background sound data which are decoded in the receiving section and the background sound reproducing section respectively, and in the receiving section, a sound in which received speech and background sound are superposed is outputted from a receiver.

11 Claims, 15 Drawing Sheets

COMMUNICATION APPARATUS

BACKGROUND OF THE INVENTION

The present invention relates to a communication apparatus for sending and receiving speech by using a digital communication line as a communication channel, such as a portable telephone and a PHS.

While everyday conversation is performed by using a digital communication line such as a conventional portable telephone or PHS, only mutual conversation speech can be heard from the telephone. Conversation only by conversation speech is apt to become businesslike in any case. In order to implement conversation accompanied by an atmosphere, there have been several inventions so far, which intended to share background sound between talkers by sending conversation speech superposed on background sound by telephone.

For instance, JP-A-11-191796 specification shows a method of sending speech and background sound with their analog waveforms superposed.

However, the above conventional technique does not allow the receiving side to adjust or stop only background sound in the case where its volume level or the background sound itself is not desirable for a listener. Thus, there was a problem that the sending side was at a loss to determine what value volume of background sound should be set at. In addition, there was a problem that, as the sending side always had the right to decide whether or not to send background sound, the receiving side cannot reject receiving of the background sound from the beginning.

Moreover, it was also a problem that, as an ordinary telephone has band limitation on transmitted signals, background sound also had band limitation resulting in deteriorated tone quality.

Furthermore, in case of implementing the inventions so far by using a conventional portable telephone, the background sound sending side must speech-encode and send analog waveforms in which conversation speech and background sound are superposed, and the background sound receiving side must speech-decode and reproduce the above described encoded speech data. As the speech-encoding method adopted to a portable telephone enhances compression effect by utilizing properties unique to speech, it does not suit any encoding other than that of speech, such as background sound. Therefore, there was a problem that quality of background sound was lost in the case of implementing the conventional inventions for sharing background sound with a conventional portable telephone.

SUMMARY OF THE INVENTION

An object of the present invention, implemented in consideration of the above circumstances, is to provide a communication apparatus for making telephone conversation pleasant and providing a good atmosphere. Another object is to provide means for adjusting volume of background sound by both apparatuses separately and also improve quality of background sound, which could not be implemented by prior arts.

To attain the above object, a communication apparatus of the present invention is characterized by a background sound sending section that has means for digital-multiplexing and sending data of encoded uttered speech from a transmitter and encoded data of background sound. Because of such a characteristic, speech and background sound are sent as digital multiple data as-is in an encoded state, so that quality of conversation speech and background sound is not lost.

In addition, in the communication apparatus of the present invention, the background sound sending side has means for decoding encoded data of the above described background sound and controlling volume thereof to superpose it on received sound. Thus, the background sound sending side can hear superposed sound of the sent background sound and received speech, and so the same background sound as that of the other party of conversation can be heard. Moreover, as background sound data to be sent is only encoded data, volume of background sound on the receiving side will not be affected even if the sending side adjusts the sound to desirable volume. Therefore, the sending side can adjust volume of the background sound to a level suitable to its own environment without being conscious of a sound environment on the receiving side.

Moreover, the communication apparatus of the present invention has means for receiving data in which speech and background sound are multiplexed, extracting a plurality of sound data from this multiplexed data, decoding the sound data individually, and controlling volume and adding to output it as one sound. As it allows the receiving side to decode encoded speech data and encoded background sound data separately, received speech and background sound can be superposed without losing quality of received speech and background sound to be heard from a receiver. In addition, as volume control is performed separately for background sound and received speech, the receiving side can adjust the background sound to desirable volume.

Furthermore, the communication apparatus of the present invention is characterized by, from the background sound sending side to the background sound receiving side, determining whether or not the receiving side has means for decoding speech background sound separately. And it is characterized by multiplexing and sending background sound in the case where the receiving side has the above described means, and sending only speech-decoded data without multiplexing background sound, the encoded background sound data is decoded and added to the speech, and then is speech-encoded in the speech sending section and is outputted from the transmission interface section to a transmission line in the case where the receiving side does not have the above described means. Such characteristics make it possible, in the case where the receiving side does not have means for demultiplexing speech and background sound, to avoid a problem that the receiving side cannot correctly reproduce them as a result of sending data in which uttered speech and background sound are multiplexed.

In addition, the communication apparatus of the present invention is characterized in that the background sound receiving side requests the background sound sending side the reject to send the background sound to the receiving side or the stoppage to send currently transmitted background sound. This characteristic makes it possible, in the case where the receiving side does not need background sound, to prevent reproduction of unnecessary background sound since the receiving side can take initiative to stop the sound.

DETAILED DESCRIPTION OF THE EMBODIMENTS

Figure 1:
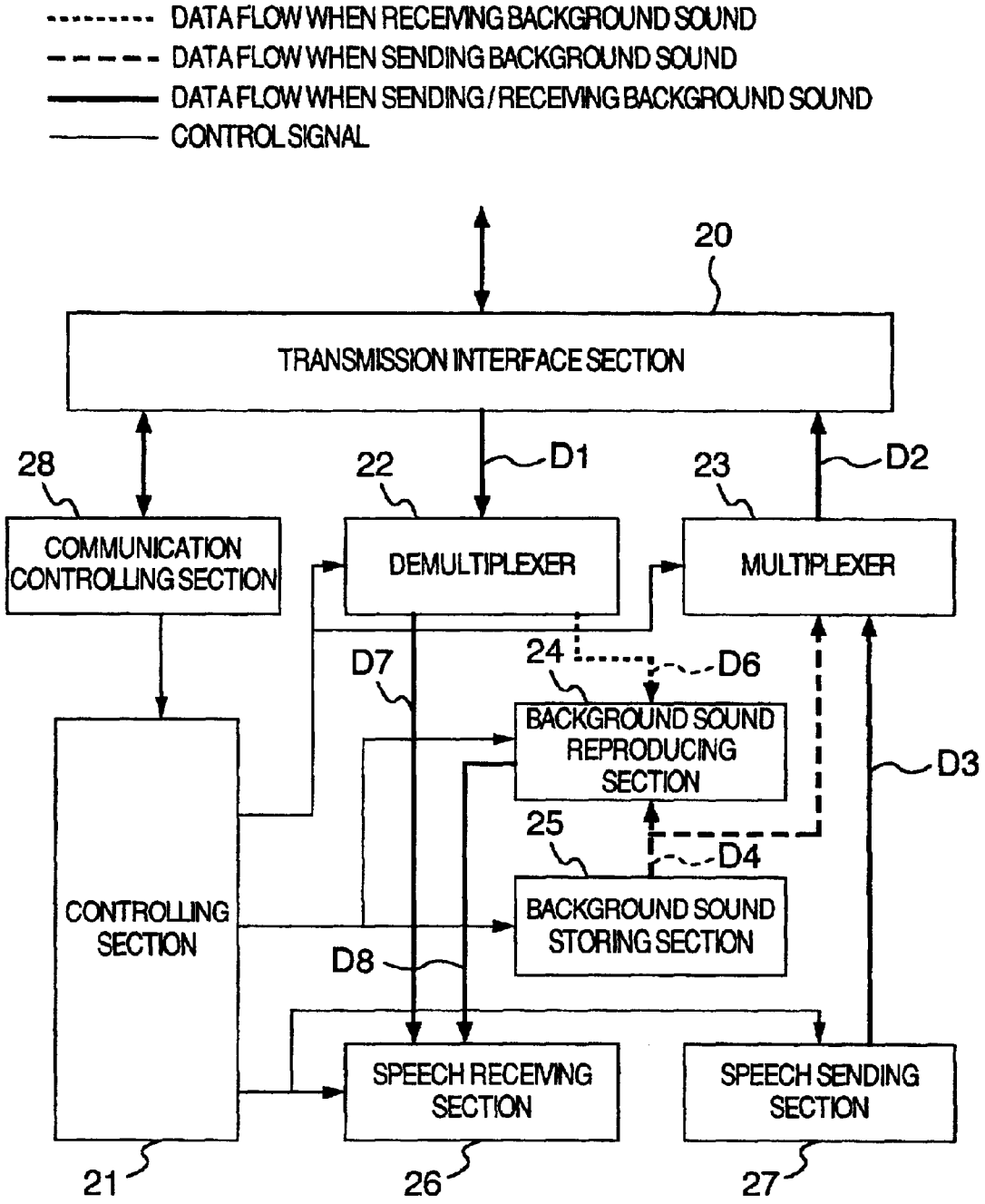
FIG. 1 is a block diagram showing a configuration of a portable telephone according to Embodiment 2 of the present invention.

Embodiments of the present invention will be described hereafter by referring to the drawings.

Figure 7:
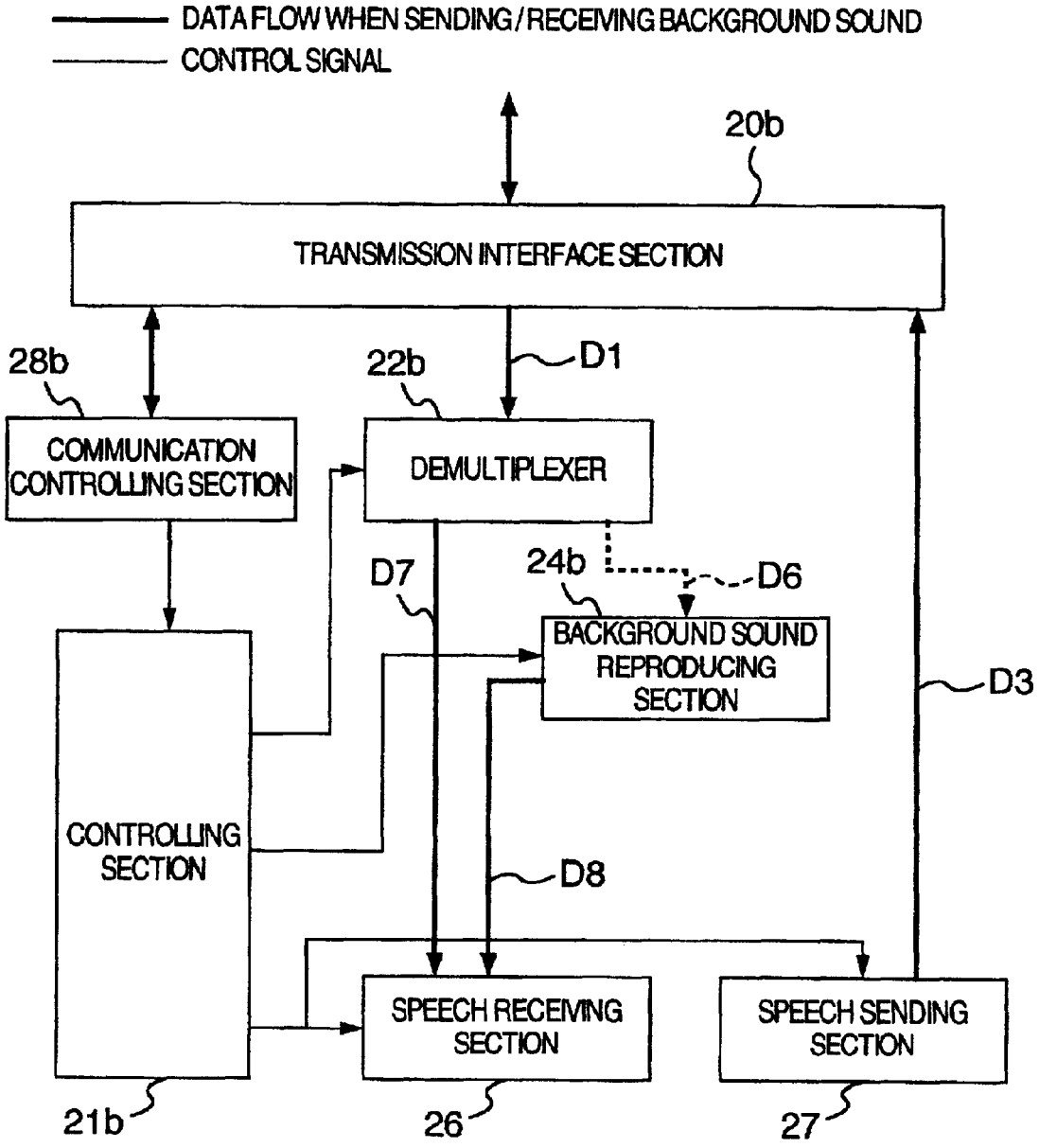
FIG. 7 is a block diagram showing a configuration of a portable telephone for receiving background sound according to Embodiment 1 of the present invention.
Figure 13:
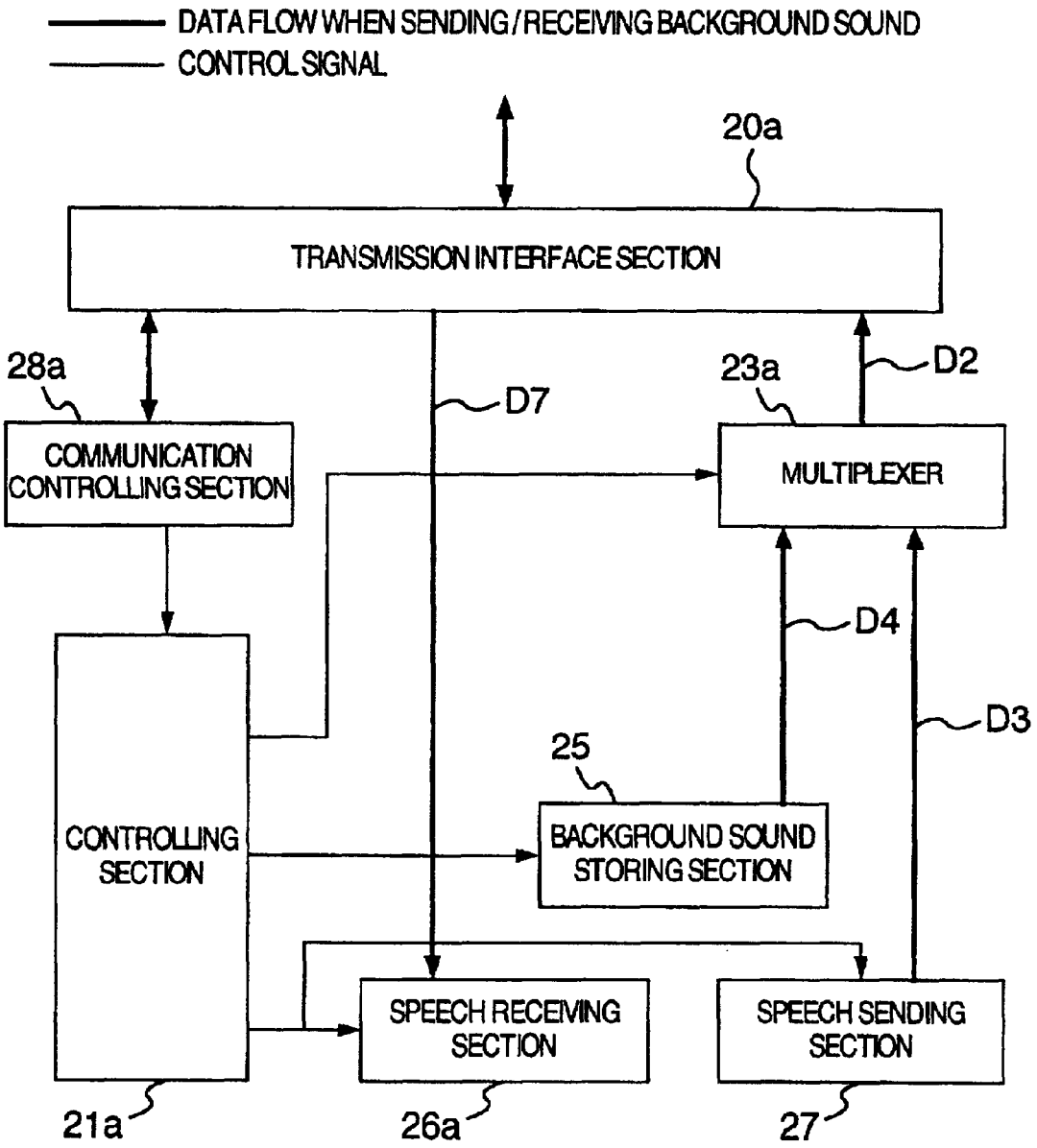
FIG. 13 is a block diagram showing a configuration of a portable telephone for sending background sound according to Embodiment 1 of the present invention.

FIG. 13 is a block diagram showing a configuration of a portable telephone that is a communication apparatus for sending background sound according to Embodiment 1 of the present invention (hereafter referred to as a background sound sending terminal). FIG. 7 is a block diagram showing a configuration of a portable telephone that is a communication apparatus for receiving background sound according to Embodiment 1 of the present invention (hereafter referred to as a background sound receiving terminal). A portable telephone shown in FIG. 7 and FIG. 13 uses a digital communication line as a communication channel, and FIG. 13 is a communication apparatus capable of sending data wherein conversation encoded speech data and encoded background sound data are multiplexed, and FIG. 7 is communication apparatus capable of receiving the above described multiplexed data.

This portable telephone according to Embodiment 1 operates in one of a normal mode for having conversation of only ordinary speech, a controlling mode for sending and receiving background sound, a background sound sending mode for sending background sound and a receiving mode for receiving background sound. To be more specific, from a conversation mode that is a state of having ordinary conversation, a background sound sending terminal shifts to a background sound sending mode, and a background sound receiving terminal shifts to a background sound receiving mode, and data wherein background sound and speech are multiplexed is sent from the background sound sending terminal to the background sound receiving terminal. Background sound is not sent in the reverse direction. How these operating modes flow will be described in detail later.

Next, details of operation of a background sound sending terminal in a background sound sending mode and operation of a background sound receiving terminal in a background sound receiving mode will be described.

First, referring to FIG. 13, detailed operation of background sound sending terminal in a background sound sending mode will be described. In FIG. 13, 20*a* is a transmission interface section, 21*a* is a controlling section, 23*a* is a multiplexer, 25 is a background sound storing section, 26*a* is a receiving section, 27 is a speech sending section, and 28 is a communication controlling section. A background sound sending apparatus configured in this manner will be described as to its functions, operation and so on.

In the speech sending section 27, a speech of a transmitting person is inputted and digitally speech-encoded, and then encoded speech data D3 is outputted. On the other hand, in the background sound storing section 25, a background sound to be sent is selected and encoded background sound data D4 is outputted. Speech-encoded data D3 and encoded background sound data D4 are inputted to multiplexer 23*a*. In the multiplexer 23*a*, D3 and D4 are digital-multiplexed and then multiplexed data D2 is outputted. In the transmission interface section 20*a*, multiplexed data D2 is inputted and then outputted to a radio transmission line, and received data D7 is outputted and then inputted to a receiving section 26 to reproduce received speech. In transmission interface section 20*a*, in addition to these functions, a communication control signal is extracted and then inputted to a communication controlling section 28*a* to process a protocol for establishing a communication channel set forth later. The controlling section 21*a* outputs a control signal in order to implement the above operation. Details of a control signal will be fully described later.

Figure 2:
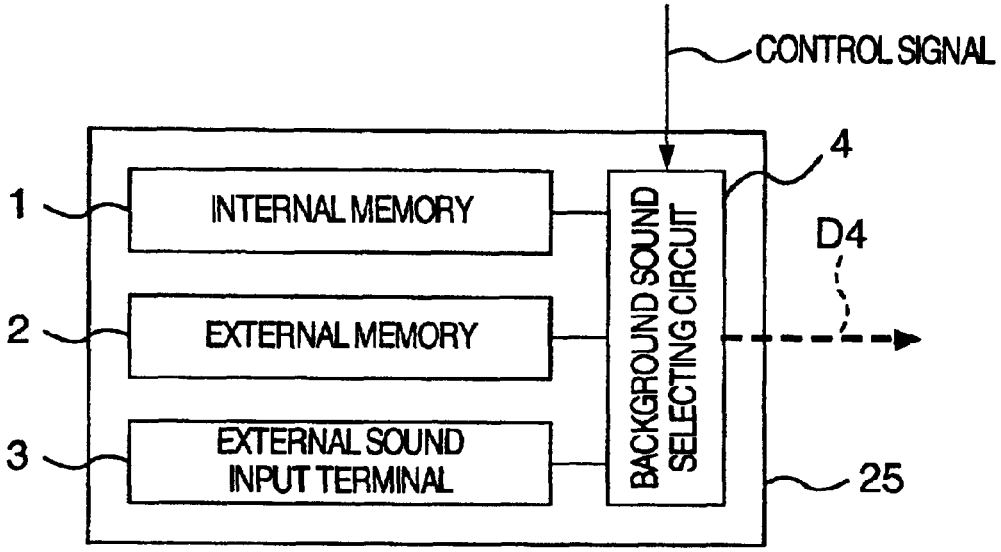
FIG. 2 is a block diagram showing a detailed configuration of a background sound storing section of a portable telephone for sending background sound according to Embodiment 1 of the present invention.

The background sound storing section 25 holds a large number of encoded background sound data, and outputs encoded background sound data D4 according to selection of a user. Detailed configuration and operation of the background sound storing section 25 will be described by referring to FIG. 2. FIG. 2 shows a detailed configuration of the background sound storing section 25. FIG. 2 shows an internal memory 1, an external memory 2 and an external sound input terminal 3 as examples of means for holding encoded background sound data. While MIDI, alert melody, PCM, MPE G1 Audio and so on can be mentioned as encoding methods of background sound held by these means for holding encoded background sound data, the present invention does not limit them to these especially. The external sound input terminal 3 is a terminal for capturing encoded data held by a CD, an MD, a personal computer, and so on, as encoded background sound data. On a background sound selecting circuit 4, according to a control signal from the controlling section 21*a*, one of the above means for holding encoded background sound data is selected, and encoded background sound data D4 is outputted.

Figure 3:
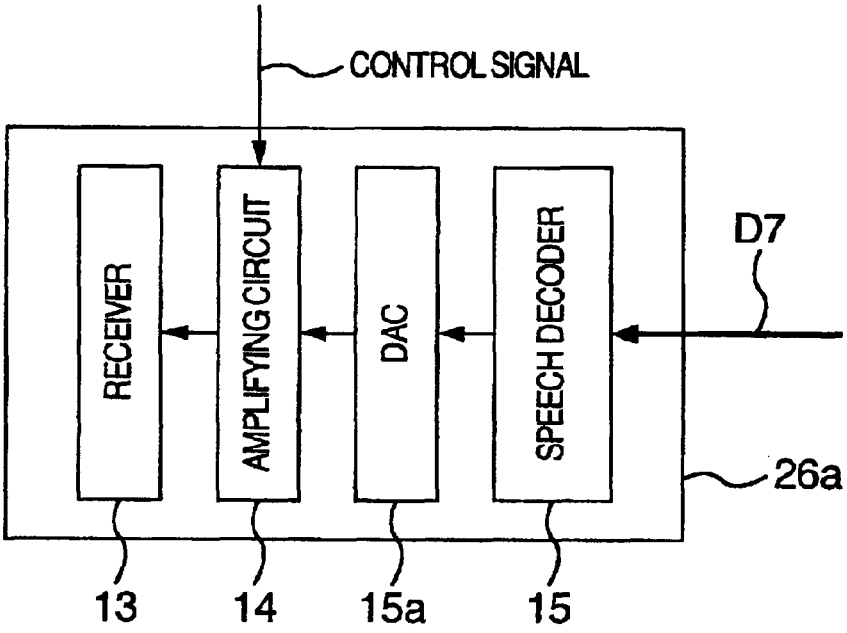
FIG. 3 is a block diagram showing a detailed configuration of a receiving section of a portable telephone for sending background sound according to Embodiment 1 of the present invention.

The receiving section 26*a* decodes received encoded speech data D7 of the other party, and outputs received speech from a receiver. A detailed configuration and an operation of the receiving section 26*a* will be described by referring to FIG. 3. FIG. 3 shows a detailed configuration of the receiving section 26*a*. Received encoded speech data D7 inputted to the receiving section 26*a* is decoded by a speech decoder 15, converted into an analog signal by a DA converter 15*a*, amplified by an amplifying circuit 14, and received speech is outputted from a receiver 13. Gain on the amplifying circuit 14 is set by a control signal from the controlling section 21.

Figure 4:
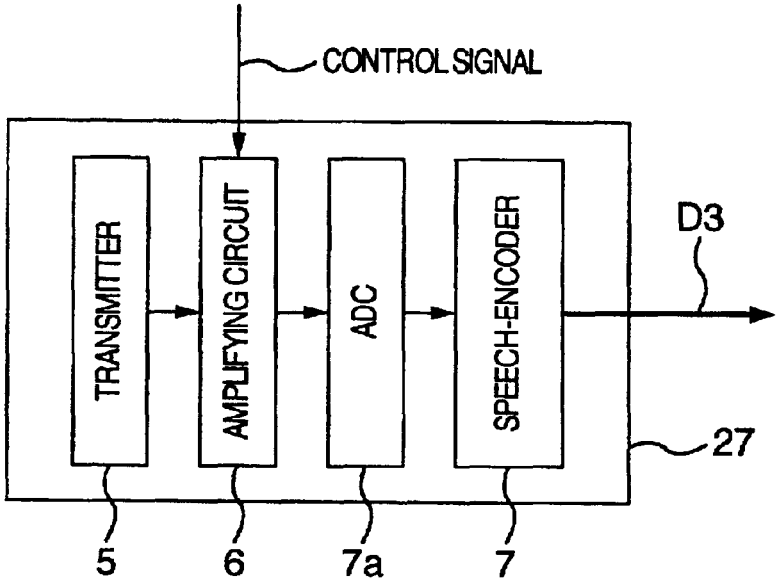
FIG. 4 is a block diagram showing a detailed configuration of a speech sending section of a portable telephone according to Embodiment 1 of the present invention.

The speech sending section 27 speech-encodes speech uttered by a user inputted in a transmitter, and outputs encoded speech data D3. Detailed configuration and operation of the speech sending section 27 will be described by referring to FIG. 4. FIG. 4 shows detailed configuration of the speech sending section 27. Speech uttered by the user is converted into an electric signal at the transmitter 5 and amplified by the amplifying section 6. Gain in the amplifying section 6 is set by a control signal from the controlling section 21*a*. A speech signal amplified by the amplifying section 6 is converted into a digital signal by an AD converter 7*a* and speech-encoded in speech-encoder 7. While G. 723.1 and G. 729 prescribed in ITU-T (International Telecommunication Union-Telecommunication standardization sector) can be mentioned as speech-encoding method in the speech-encoder 7, the present invention does not limit it to them especially. Speech-encoded data outputted by the speech-encoder 7 is outputted as D3 from the speech sending section 27.

Figure 5:
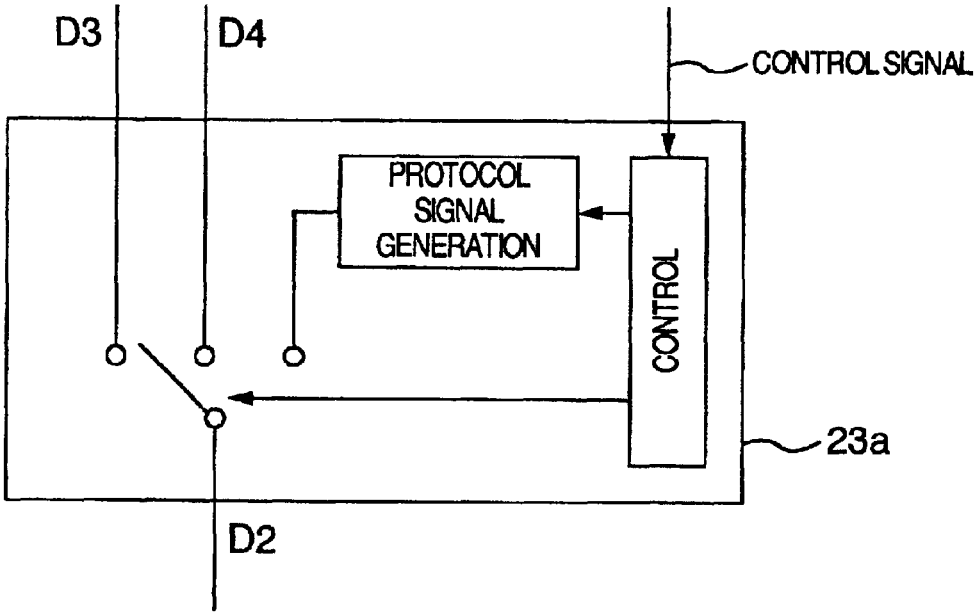
FIG. 5 is a block diagram showing a conceptual configuration of a multiplexer of a portable telephone for sending background sound according to Embodiment 1 of the present invention.

The multiplexer 23*a* digital-multiplexes encoded speech data D3 and encoded background sound data D4 and outputs multiplexed data D2. A configuration of the multiplexer 23*a* will be described by referring to FIG. 5. FIG. 5 shows a conceptual configuration of the multiplexer 23*a*. A controlling section in FIG. 5 switches a data input source to any one of D3, D4 or a protocol signal generating section in compliance with information such as multiplexing table mentioned later. Protocol signal generating section in FIG. 5 generates protocol signals such as a sequence number, CRC and a header section mentioned later.

Figure 6:
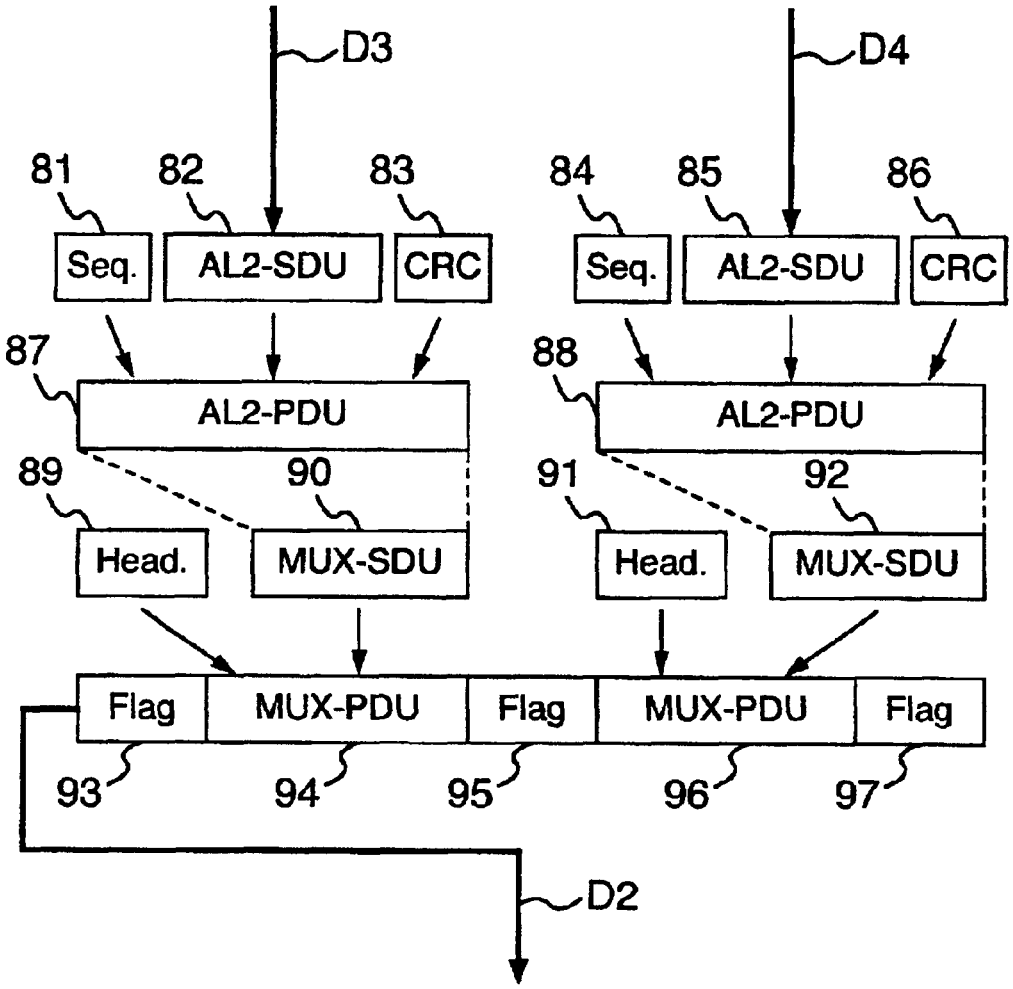
FIG. 6 is a block diagram showing a detailed processing of a multiplexer of a portable telephone for sending background sound according to Embodiment 1 of the present invention.

Details of processing in the multiplexer 23*a* will be described by referring to FIG. 6. FIG. 6 shows data flow in the multiplexer 23*a* as a concept. FIG. 6 shows an example of using ITU-T H. 223 as a digital-multiplexing method. The following description uses the symbol names described in H. 223 as-is.

Speech-encoded data D3 inputted to the multiplexer 23*a* is received by a packet called AL2-SDU (82). AL2-SDU is a packet for sending speech and audio data on a logical channel, and AL2-SDU is normally one frame data. A sequence number (81) and a CRC (Cyclic Redundancy Check) check bit (83) are added to this AL2-SDU to be received by a packet called AL2-PDU (87). Likewise, encoded background sound data D4 inputted to the multiplexer 23*a* is received as AL2-SDU (85), and a sequence number (84) and a CRC check bit (86) are added to this AL2-SDU to be received by AL2-PDU (88). Next, AL2-PDU (87) is received by a packet called MUX-SDU (90) and AL2-PDU (88) by MUX-SDU (91) respectively. MUX-SDU (90) is not divided, but a header section (89) is added to its head and received as MUX-PDU (94). Likewise, MUX-SDU (92) is not divided, but a header section (91) is added to its head and received as MUX-PDU (96). As H. 223 normally receives speech data as indivisible AL2-SDU, the above described MUX-SDUs are not divided. The header section 89 and the header section 91 include the entry number of an H. 223 multiplexing table sent by a multiplexing control signal issued by the controlling section 21*a*. An H. 223 multiplexing table includes information on multiplexing such as what bytes of encoded speech data and what bytes of encoded background sound data are included in MUX-PDU. MUX-PDU (94) and MUX-PDU (96) are outputted as multiplexed data D2, as shown in FIG. 6, as if sandwiched among synchronization flags 93, 95 and 97. A synchronization flag is specific bit pattern data for identifying positions of the head and bottom of a MUX-PDU on demultiplexing mentioned later.

A flow of sending background sound in a background sound sending mode of a background sound sending terminal of the above configuration will be summarized by referring to FIG. 13. After establishing in the communication controlling section 28*a* a communication channel for sending and receiving background sound mentioned later, uttered encoded speech data D3 outputted from the speech sending section 27 and encoded background sound data D4 outputted from the background sound storing section 25 are inputted to the multiplexer 23*a*, and multiple data D2 of uttered speech and background sound are modulated in the transmission interface section 20*a* and sent to the other terminal. On the other hand, received encoded speech data D7 demodulated in the transmission interface section 20*a* is decoded and amplified in receiving section 26*a* and outputted as received sound.

As mentioned above, in a background sound sending terminal in Embodiment 1 of the present invention, uttered speech and background sound are multiplexed as separately encoded digital data respectively and sent, so that quality of uttered speech and background sound does not deteriorate and conversation in better atmosphere can be enjoyed.

Next, a detailed operation of a background sound receiving terminal in a background sound receiving mode will be described by referring to FIG. 7. In FIG. 7, 20*b* is a transmission interface section, 21*b* is a controlling section, 22*b* is a multiplexer, 24*b* is a background sound reproducing section, 26 is a receiving section, 27 is a speech sending section, and 28*b* is a communication controlling section. A background sound receiving apparatus configured in this manner will be described as to its functions, operation and so on. Moreover, description will be omitted as to the speech sending section 27 since it has the same functions as the speech sending section 27 in the above described background sound sending terminal (FIG. 4).

The transmission interface section 20*b* outputs received multiplexed data D1 and also outputs uttered encoded speech data generated in the speech sending section 27 to a radio transmission line. In the transmission interface section 20*b*, in addition to these functions, a communication control signal is extracted and then inputted to the communication controlling section 28*b* to process a protocol for establishing a communication channel set forth later. The controlling section 21*b* outputs a control signal in order to implement the above operation. Details of the control signal will be fully described later. In the demultiplexer 22*b*, the multiplexed data D1 is demultiplexed to output received encoded speech data D7 and encoded background sound data D6. D6 is inputted to the background sound reproducing section 24*b* and decoded, and background sound reproducing signal D8 is outputted and then inputted to the receiving section 26. In the receiving section 26, received encoded speech data D7 is decoded and superposed on background sound signal D8, and then sound is outputted from a receiver.

Figure 8:
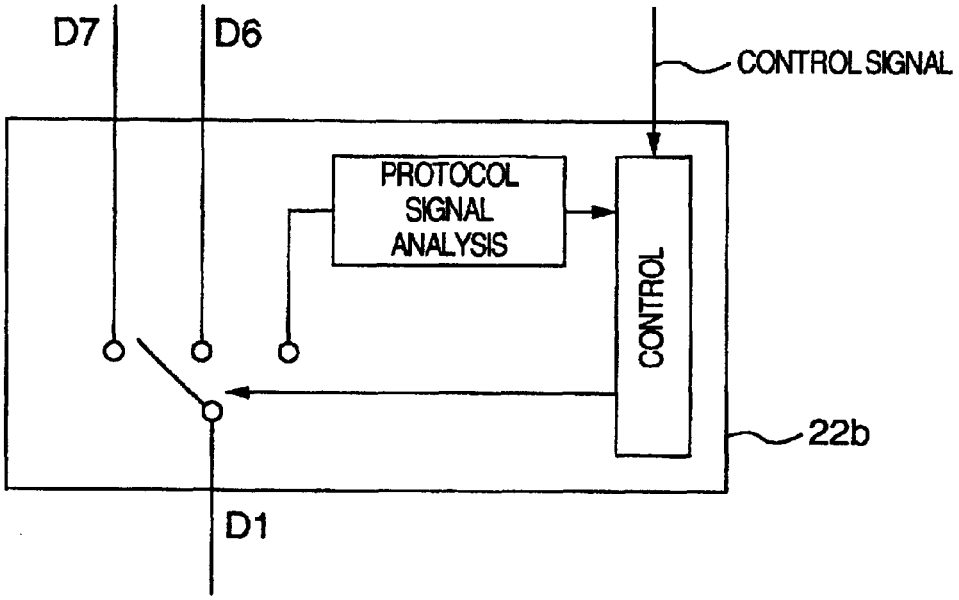
FIG. 8 is a block diagram showing a conceptual configuration of a demultiplexer of a portable telephone for receiving background sound according to Embodiment 1 of the present invention.

The demultiplexer 22*b* separates received multiplexed data D1 into received encoded speech data D7 and encoded background sound data D6 and outputs them respectively. A configuration of the demultiplexer 22*b* will be described by referring to FIG. 8. FIG. 8 shows a conceptual configuration of the demultiplexer 22*b*. A protocol signal analyzing section in FIG. 8 reads protocol signals such as a sequence number, CRC and a header section mentioned later and sends them to a controlling section. The controlling section in FIG. 8 switches a data output destination to D7, D6 and the protocol signal analyzing section according to information such as a header information and multiplexing table sent from the protocol signal analyzing section.

Figure 9:
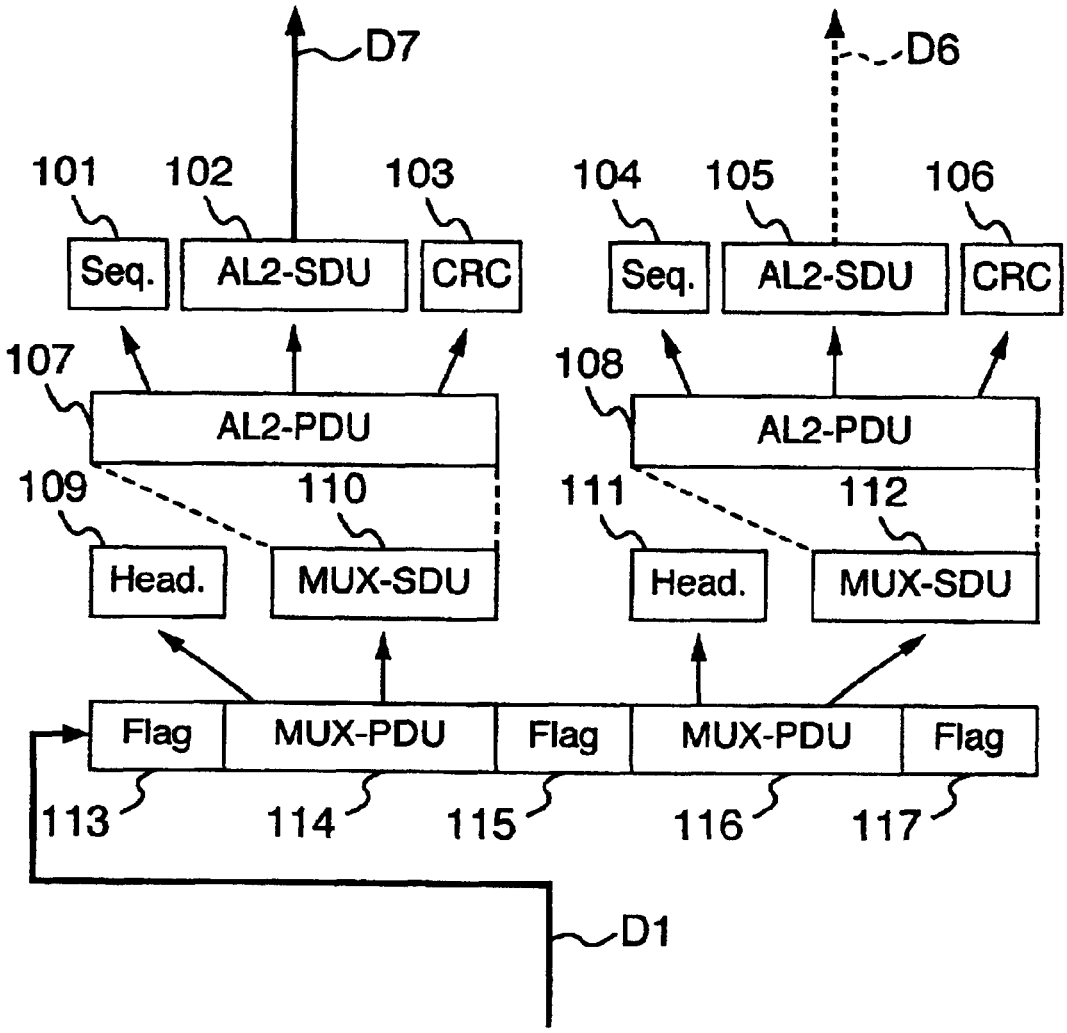
FIG. 9 is a block diagram showing a detailed processing of a demultiplexer of a portable telephone for receiving background sound according to Embodiment 1 of the present invention.

Details of processing in the demultiplexer 22*b* will be described by referring to FIG. 9. FIG. 9 shows data flow in the demultiplexer 22*b* as a concept. FIG. 9 shows an example of using ITU-T H. 223 as a digital-multiplexing method just as in FIG. 6. The following description uses the symbol names described in H. 223 as-is.

Multiplexed data D1 inputted to the demultiplexer 22*b* has MUX-PDUs (114 and 116) sandwiched among synchronization flags 113, 115 and 117 as shown in FIG. 9. A synchronization flag is specific bit pattern data, which is prescribed as "0111 1110" in H. 223. The demultiplexer always detects a synchronization flag pattern against inputted data D1 and extracts a MUX-PDU. It reads header section 109 from the head of MUX-PDU (114) and extracts MUX-SDU (110) by referring to a multiplexing table entry number included therein. As aforementioned, speech data is normally sent by an indivisible logical channel in H. 223, so that only one MUX-SDU (110) is taken out of one MUX-PDU (114). MUX-SDU (110) is received by AL2-PDU (107) and divided into a sequence number (101), AL2-SDU (102) and a CRC check bit (103). Sequence number (101) is used for detection of packet loss. CRC check bit (103) is used for detection of an error in AL2-PDU. Extracted AL2-SDU (102) is outputted as encoded speech data D7 together with CRC error detection information. Even in the case where an error is detected by CRC, extracted encoded speech data D6 is outputted as-is. It is also possible to use CRC error detection information in the receiving section 26 in order to enhance an error resilience. The same process is performed as to MUX-PDU (116) and extracted encoded background sound data D6 is outputted.

Moreover, in the case where a user intends not to reproduce background sound, it is possible to abandon separated encoded background sound data D6 according to an instruction of multiplexing control signal sent from controlling section 21*b*.

Figure 10:
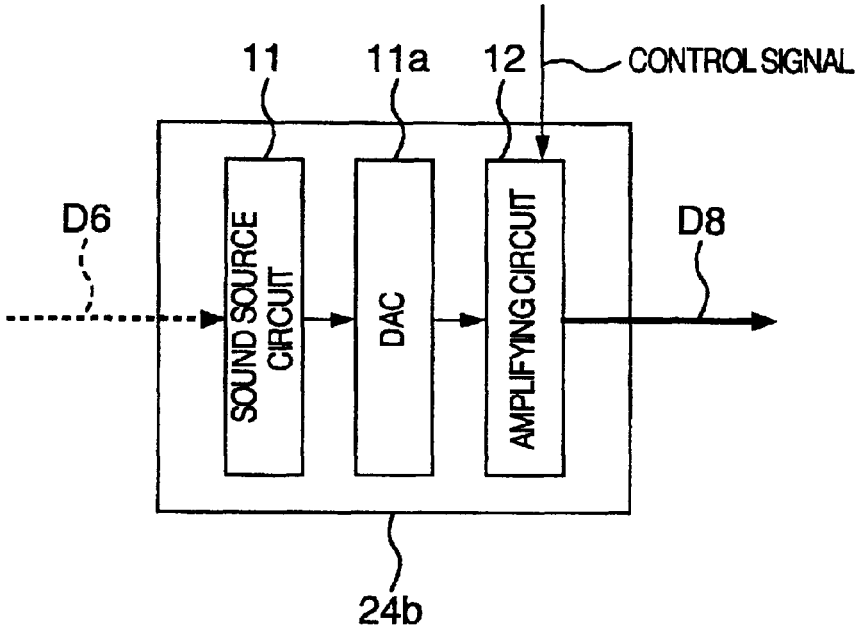
FIG. 10 is a block diagram showing a detailed configuration of a background sound reproducing section of a portable telephone for receiving background sound according to Embodiment 1 of the present invention.

FIG. 10 shows a detailed configuration of the background sound reproducing section 24*b*. The background sound reproducing section 24*b* is comprised of the sound source circuit 11, the DA converter 11*a* and the amplifying circuit 12. Background sound-encoded data D6 inputted to the background sound reproducing section 24*b* is decoded on the sound source circuit 11, converted into an analog signal by the DA converter 11*a*, and amplified on the amplifying circuit 12 and then outputted as background sound signal data D8. Amplification gain on the amplifying circuit 12 is set by a sound volume control signal sent from the controlling section 21*b*.

Figure 11:
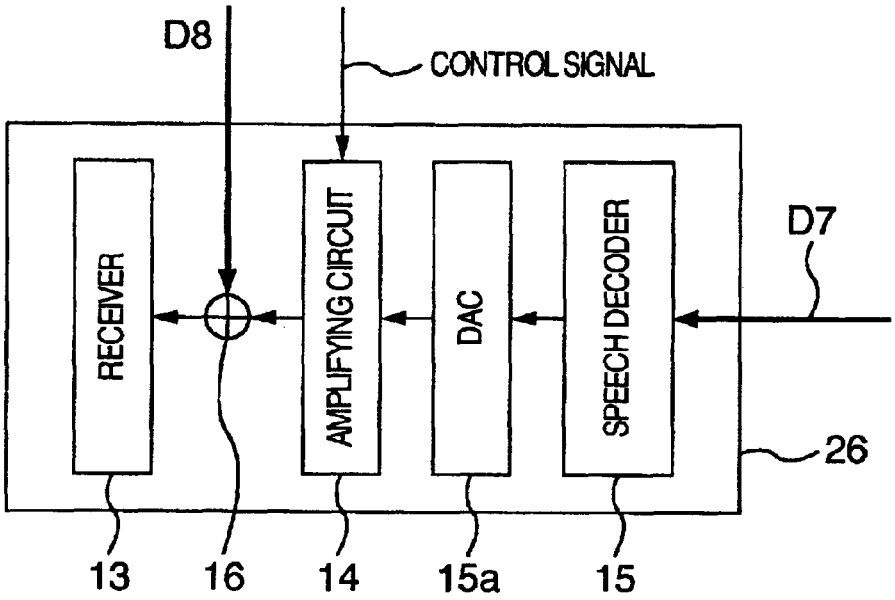
FIG. 11 is a block diagram showing a detailed configuration of a receiving section of a portable telephone for receiving background sound according to Embodiment 1 of the present invention.

FIG. 11 shows a detailed configuration of the receiving section 26. The receiving section 26 is configured by adding input means and adding means 16 of background sound signal data D8 to the receiving section 26 of the above-mentioned background sound sending apparatus. In FIG. 11, as the speech-encoder 15, the DA converter 15*a*, the amplifying circuit 14, the receiver 13 and input encoded speech data D7 have the same functions as those of the receiving section 26*a* in FIG. 3, the numbers same as FIG. 3 are given. The process in which D7 is decoded/amplified is the same as that in receiving section 26*a*. A function of the receiving section 26 different from those of the aforementioned receiving section 26*a* is that background sound signal D8 and a speech signal outputted from the amplifying circuit 14 are superposed by the adding means 16 to be outputted from the receiver 13. Due to this function, in the receiving section 26 in a background sound receiving apparatus, sound wherein received speech and background sound are superposed is outputted.

A flow of receiving background sound in a background sound receiving apparatus of the above configuration will be summarized by referring to FIG. 7. A communication channel for sending and receiving background sound mentioned earlier is established in the communication controlling section 28*b*. After establishing this receiving channel, a multiplexed signal sent from the aforementioned background sound sending apparatus is demodulated to multiplexed data D1 in the transmission interface section 20*b*. D1 is demultiplexed into received encoded speech data D7 and encoded background sound data D6 in the multiplexer 22*b*. D6 is decoded and amplified in a background sound reproducing section, and background sound signal D8 is sent to the receiving section 26. In the receiving section 26, received encoded speech data D7 is decoded and amplified and superposed on background sound signal D8, and sound wherein received speech and background sound are superposed is outputted. On the other hand, uttered decoded speech data D3 outputted by the speech sending section 27 is sent to the transmission interface section 20*b*, and is modulated in 20*b* to be sent to the other party.

As mentioned above, a background sound receiving terminal according to Embodiment 1 of the present invention demultiplexes received multiplexed data into received encoded speech data and encoded background sound data so as to decode and adjust volume of received speech and background sound separately. As speech and background sound are decoded separately, quality of received speech and background sound does not deteriorate much. In addition, as volume of speech and background sound can be adjusted separately, the receiving side can adjust volume of background sound as desired according to a surrounding environment. Moreover, in the case where the receiving side does not require background sound, encoded background sound data can be abandoned easily so as to prevent unnecessary output of background sound.

A flow from a state of mutually having conversation by using a background sound sending terminal and a background sound receiving terminal according to Embodiment 1 to sending and receiving of background sound, and a flow of stopping sending and receiving background sound and returning to a normal conversation state will be described by referring to FIG. 12.

Before sharing background sound, a normal communication channel is established between portable telephones of both talkers, and they are having normal conversation by sending and receiving encoded speech data via this conversation channel (S31). This state is called a normal mode.

Next, a procedure request for sending background sound from a background sound sending terminal is sent to a background sound receiving terminal that is the other party (S32). This form of a message of a request for sending background sound depends on a communication mode of a portable telephone in use. To be more specific, in the case where a channel for sending and receiving information between talkers cannot be secured other than a normal speech channel, a procedure request is sent through a normal speech channel.

On the other hand, in the case where a channel for sending and receiving information between talkers other than a normal speech channel can be secured, a message is sent through a channel different from a normal speech channel.

In this Embodiment, an example in the former communication mode will be described. In this Embodiment, background sound receiving request message S31 and responding message thereto S32 and a rejecting message (unillustrated) are defined by an acoustic signal of a certain unique frequency pattern. A background sound sending terminal speech-encodes S31, sends it to a normal speech channel and waits for responding message S32 from the other terminal. The background sound sending terminal decodes encoded speech data from a normal speech channel, and then always matches responding message S32 with a rejecting message, and if S32 is detected, it determines that a background sound receiving request is accepted by a background sound receiving terminal and enters a controlling mode for itself.

Processing in the case where responding message S32 is not received will be described. Here, the cases where S32 is not received represent the following. (1) A rejecting message is received. (2) A signal other than S32 (such as the other party's speech) is received. (3) Predetermined time has passed. In the case where S32 is not received, S31 is resent. This resending is performed a predetermined maximum number of times until S32 is received. In the case where S32 is not received even by repeating resending a maximum number of times, it determines that the other terminal is not equipped with a function of this Embodiment and stops sending background sound to return to a normal mode, wherein when it is determined that the other apparatus is not provided with a function of decoding speech and background sound separately; the encoded background sound data is decoded and added to the speech, and then is speech-encoded in the speech sending section and is outputted from the transmission interface section to a transmission line.

Also, in the case where it detects receipt of a rejecting message in the above-mentioned state of waiting for a message from the other terminal, it stops sending background sound and returns to a normal mode.

On the other hand, the background sound receiving terminal decodes encoded speech data from a normal speech channel, and then always performs matching with background sound receiving request message S31, and if message S31 is detected, it speech-encodes acoustic signal S32 defined as a responding message (hereafter merely referred to as responding message) and sends it to the background sound sending terminal, and then enters a controlling mode.

In a controlling mode, information parameter setting S33 required for performing multiplex communication of conversation encoded speech data and encoded background sound data is performed. As a standard of a control protocol for such multimedia multiplex communication, there is ITU-T H. 245 for instance. In addition, as a standard for multimedia multiplexing protocol assuming a communication environment such as mobile communication in which a transmission error easily occurs, there is ITU-T H. 223. A portable telephone of this Embodiment performs parameter setting S33 for multiplex communication in H. 223 mode by message exchange prescribed by H. 245 in a controlling mode. S33 performs by H. 245 message exchange master-slave decision, terminal communication ability exchange, H. 223 multiplexing table exchange, H. 223 logical channel opening and so on. H. 223 multiplexing table is information on configuration of H. 223 multiplexed data, and in H. 223, this multiplexing table is referred to and data from a plurality of information sources is multiplexed and demultiplexed. In this Embodiment, two logical channels, namely encoded speech data channel (one-way) and encoded background sound data channel (one-way) are established.

In the above-mentioned message exchange S33 in a controlling mode, a background sound sending terminal can determine whether the other terminal has functions of this Embodiment. Thus, it is possible, in the case where the other terminal does not have functions of this Embodiment, to prevent multiplexing and sending of background sound so as not to break down communication with the other terminal. In addition, as receiving ability of the other terminal can be grasped, it is possible to set multiplexing parameters according to the receiving ability.

If the above message exchange S33 in a controlling mode is completed, a background sound sending terminal enters into a background sound sending mode and a background sound receiving terminal enters into a background sound receiving mode. At this stage, the background sound sending terminal enters into state S34 in which multiplexed data of encoded speech data and encoded background sound data can be sent.

A flow from state S34 of having conversation while sending and receiving background sound to terminating that sending and receiving will be described. A request for terminating sending and receiving background sound can be issued from either a background sound sending terminal or a background sound receiving terminal. The following will be described by referring to a terminal sending a request for terminating sending and receiving background sound as a termination requesting terminal. However, FIG. 12 shows a flow in the case where a background sound sending terminal is the termination requesting terminal.

Like the aforementioned message S31 for starting sending and receiving background sound, termination requesting message S35 and responding message S36 thereto are defined by an acoustic signal of a certain unique frequency pattern. Both terminals decode received encoded speech data, and then always perform matching with termination requesting message S35, and operate in a state capable of detecting message S35. A termination requesting terminal speech-encodes S35 in the speech sending section 27 as mentioned later, sends it as uttered speech data and then waits for responding message S36 from the other terminal. To be more specific, the termination requesting terminal decodes received encoded speech data by a method mentioned later, and then always performs matching with S36 and enters into a state capable of detecting S36. On the other hand, the other terminal that detected receipt of S35 speech-encodes acoustic signal S36 defined as a responding message by a method mentioned later, and sends it to a termination requesting terminal, and then enters into a normal mode.

If a termination requesting terminal detects receipt of S36, it determines that a termination request is accepted by a background sound receiving terminal, and enters into a conversation mode for itself.

In the above-mentioned flow from state S34 of having conversation while sending and receiving background sound to terminating that sending and receiving, message S35 can also be sent from a background sound receiving terminal. In this case, the above-mentioned processing of the background sound receiving terminal and background sound sending terminal is reversed.

According to the above-mentioned flow, a portable telephone according to Embodiment 1 can send and receive background sound data while having conversation.

FIG. 1 is a block diagram showing a configuration of a portable telephone that is a communication apparatus for sending and receiving a background sound according to Embodiment 2 of the present invention. The portable telephone shown in FIG. 1 is a communication apparatus that has a configuration combining functions of the background sound sending apparatus and functions of the background sound receiving apparatus of Embodiment 1, and is capable of sending and receiving data wherein conversation encoded speech data and encoded background sound data are multiplexed.

A flow from a state of mutually having conversation by using two portable telephones to sending and receiving background sound, and a flow of stopping sending and receiving background sound and returning to ordinary conversation in Embodiment 2 are the same as the flows in Embodiment 1. While the portable telephones of Embodiment 2 operate in either a background sound sending mode or a background sound receiving mode, if one is in the background sound sending mode, the other certainly operates in the background sound receiving mode.

Next, details of a portable telephone for sending and receiving background sound in Embodiment 2 of the present invention will be described by referring to FIG. 1. In FIG. 1, 20 is a transmission interface section, 21 is a controlling section, 22 is a demultiplexer, 23 is a multiplexer, 24 is a background sound reproducing section, 25 is a background sound storing section, 26 is a receiving section, 27 is a speech sending section, and 28 is a communication controlling section. Detailed operation of each individual section will be described below.

The transmission interface section 20 demodulates receiver signals and modulates transmitter signals just as in Embodiment 1. However, it functions as the transmission interface section 20*a* in a background sound sending terminal of Embodiment 1 when in a background sound sending mode, and functions as the transmission interface section 20*b* in a background sound receiving terminal of Embodiment 1 when in a background sound receiving mode.

The controlling section 21 sends a control signal to each of the sections comprising a portable telephone in Embodiment 2 according to a user's operation and a control signal from communication controlling section 28. Control signals to be sent to each of the sections will be described when describing details of each of the sections.

Figure 12:
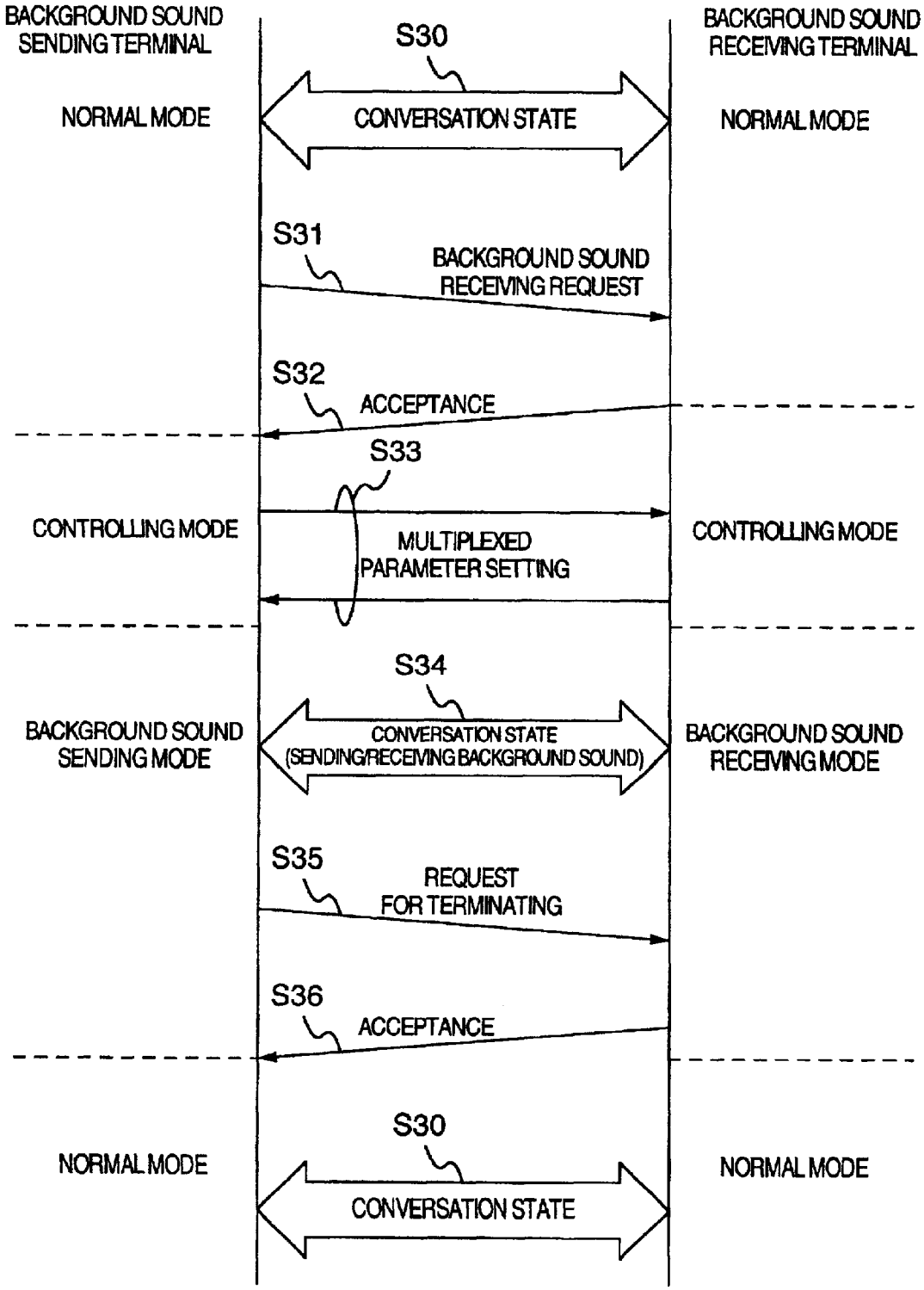
FIG. 12 is a sequence diagram showing starting and terminating procedures of sending and receiving background sound of a portable telephone according to Embodiment 1 of the present invention.

The communication controlling section 28 exchanges messages for establishing a communication channel for sending and receiving background sound as illustrated in FIG. 12 in Embodiment 1. It functions as the communication controlling section 28*a* of Embodiment 1 in the case of a background sound sending terminal, and functions as the communication controlling section 28*b* of Embodiment 1 in the case of a background sound receiving terminal.

The speech sending section 27 has the same functions as the speech sending section 27 in a background sound sending terminal (or a background sound receiving terminal) of Embodiment 1.

The receiving section 26 has the same functions as the receiving section 26 in a background sound receiving terminal of Embodiment 1.

The background sound storing section 25 has the same functions as the background sound storing section 25 in a background sound sending terminal of Embodiment 1. However, when in a background sound sending mode, encoded background sound data D4 selected according to a user's instruction is outputted to both the multiplexer 23 and the background sound reproducing section 24.

Figure 14:
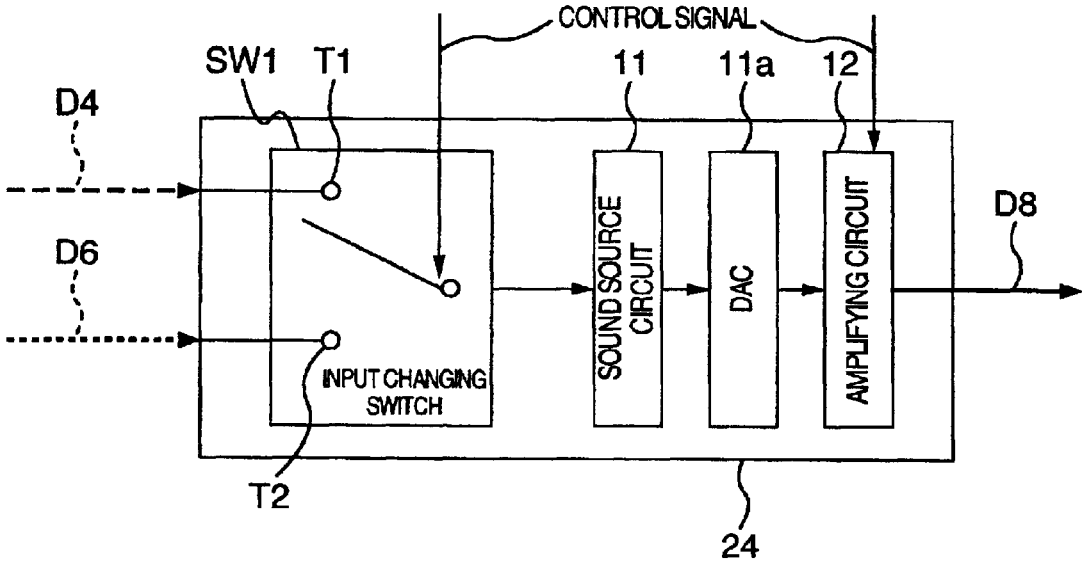
FIG. 14 is a block diagram showing a detailed configuration of a background sound reproducing section of a portable telephone according to Embodiment 2 of the present invention.

FIG. 14 snows a detailed configuration of the background sound reproducing section 24. In FIG. 14 a sound source circuit 11, a DA converter 11*a*, an amplifying circuit 12, input encoded background sound data D6 and outputted background sound signal data D8 are the same as those shown in the background sound reproducing section 24*b* of the Embodiment 1. In the background sound reproducing section 24 of Embodiment 2, an input changing switch SW1 is newly added to the configuration, which switches input of encoded background sound data to D6 or D4. In a background sound receiving mode, encoded background sound data D6 separated from received multiplexed data becomes input in the demultiplexer 22. In a background sound sending mode, encoded background sound data D4 sent from the background sound reproduction section 25 becomes input. This input switching is instructed by a control signal sent from the controlling section 21.

Figure 15:
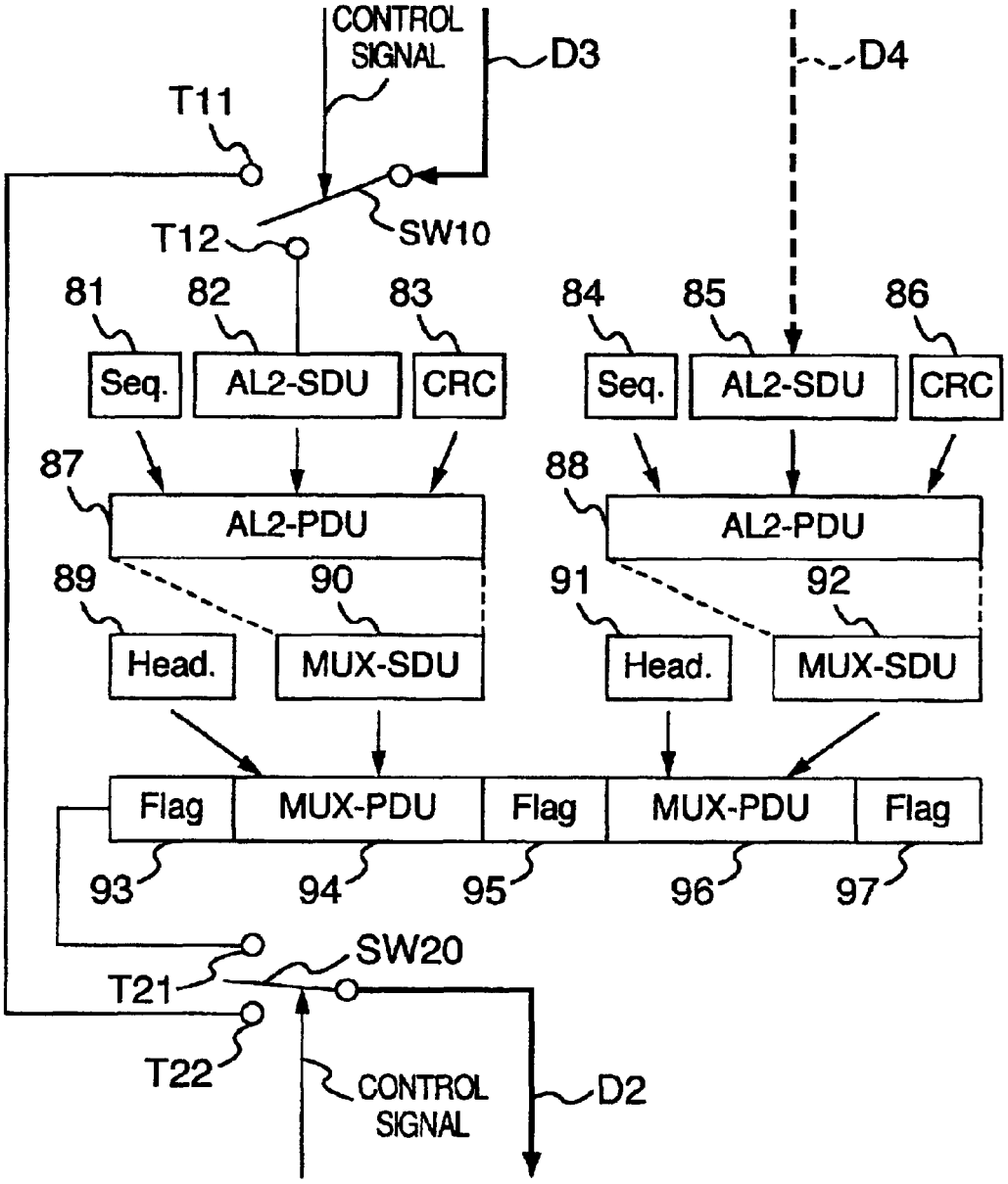
FIG. 15 is a block diagram showing a detailed processing of a multiplexer of a portable telephone for sending background sound according to Embodiment 2 of the present invention.

The multiplexer 23 functions as the multiplexer 23*a* in a background sound sending terminal of Embodiment 1 when in a background sound sending mode. To be more specific, it outputs multiplexed data of uttered encoded speech data D3 and encoded background sound data D4 as output D2 to the transmission interface section 20. On the other hand, when in a background sound receiving mode, as in a background sound receiving terminal of Embodiment 1, it outputs uttered encoded speech data D3 outputted by speech sending section 27 as-is as D2. Details of processing of multiplexer 23 will be described by referring to FIG. 15. In FIG. 15, the functions of the sections indicated by 81 to 97 are the same as those of the multiplexer 23*a* of Embodiment 1 shown in FIG. 6 respectively. In multiplexer the 23, SW 10 and SW 20 are newly added to the configuration, and SW 10 switches input destination of input encoded speech data D3 and SW 20 switches output data D2 respectively. Switching of SW 10 and SW 20 is instructed by a control signal sent from the controlling section 21. To be more specific, when in a background sound sending mode, SW 10 is connected to a terminal T12 and SW 20 is connected to a terminal T21 respectively. In this state of connection, when in a background sound sending mode, uttered encoded speech data D3 and encoded background sound data D4 are multiplexed in the same flow as that of the multiplexer 23*a* of Embodiment 1, and multiplexed data D2 is outputted. On the other hand, when in a background sound receiving mode, SW 10 is connected to a terminal T11 and SW 20 is connected to a terminal T22 respectively. In this state of connection, when in a background sound receiving mode, uttered encoded speech data D3 is outputted as-is as D2 without being demultiplexed just as a background sound receiving terminal of Embodiment 1 (FIG. 7).

Figure 16:
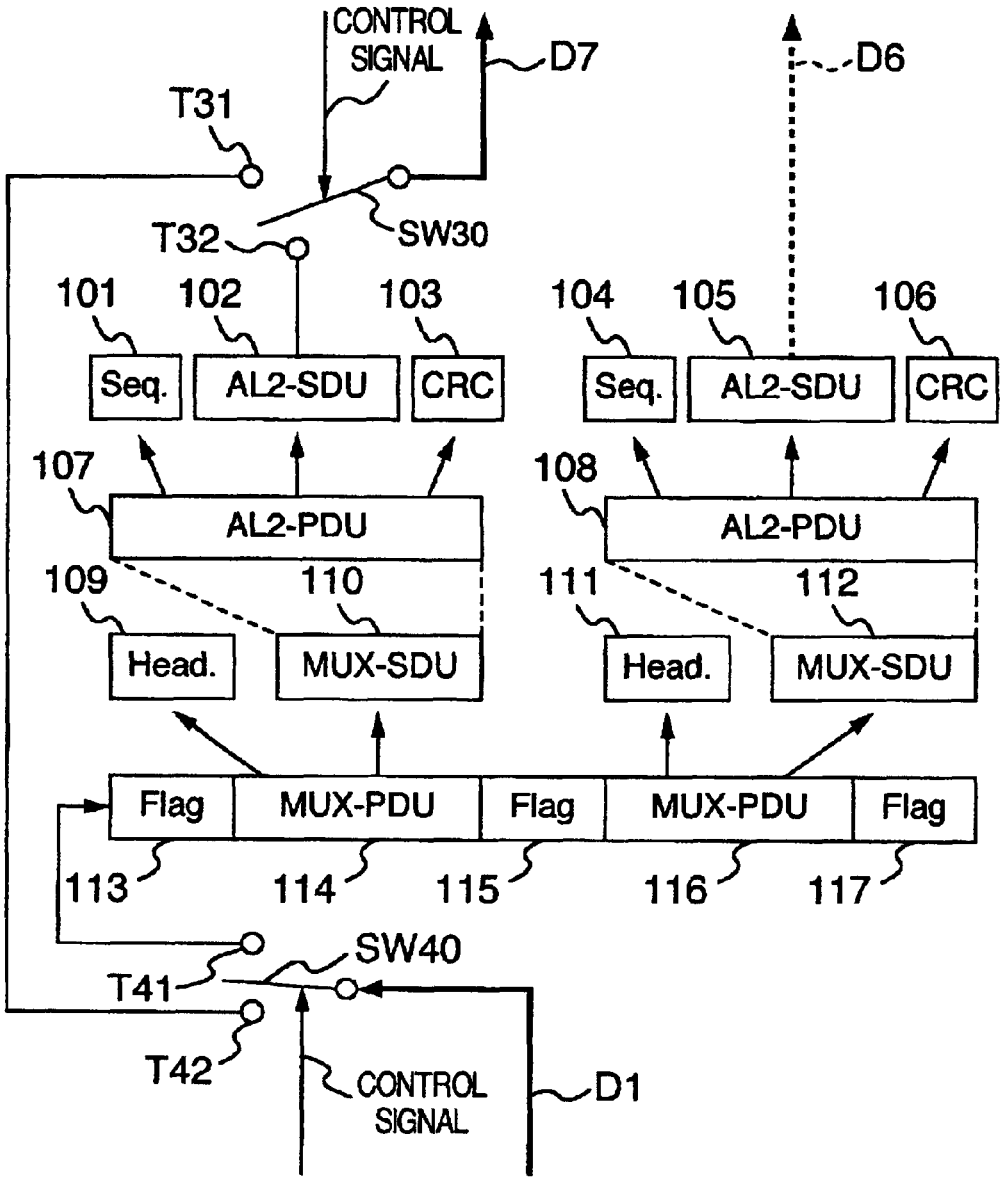
FIG. 16 is a block diagram showing a detailed processing of a demultiplexer of a portable telephone for receiving background sound according to Embodiment 2 of the present invention.

The multiplexer 22 functions as the multiplexer 22*b* in a background sound receiving terminal of Embodiment 1 when in a background sound receiving mode. To be more specific, it demultiplexes multiplexed data D1 sent from the transmission interface section 20 into received encoded speech data D7 and encoded background sound data D6, and outputs them respectively. On the other hand, when in a background sound sending mode, as in a background sound sending terminal of Embodiment 1, it outputs received encoded speech data D1 sent from the transmission interface section 20 as-is as D7. Details of processing of the demultiplexer 22 will be described by referring to FIG. 16. In FIG. 16, the functions of the sections indicated by 101 to 117 are the same as those of the demultiplexer 22*b* of Embodiment 1 shown in FIG. 9 respectively. In the demultiplexer 22, SW 30 and SW 40 are newly added to the configuration, and SW 30 switches output encoded speech data D7 and SW 40 switches input destination of input data D6 respectively. Switching of SW 30 and SW 40 is instructed by a control signal sent from the controlling section 21. To be more specific, when in a background sound receiving mode, SW 30 is connected to terminal T32 and SW 40 is connected to terminal T41 respectively. In this state of connection, when in a background sound receiving mode, multiplexed data D1 is demultiplexed in the same flow as that of the demultiplexer 22*b* of Embodiment 1, and received encoded speech data D7 and encoded background sound data D6 are outputted. On the other hand, when in a background sound sending mode, SW 30 is connected to terminal T31 and SW 40 is connected to terminal T42 respectively. In this state of connection, when in a background sound sending mode, uttered encoded speech data D3 is outputted as-is as D7 without being multiplexed just as a background sound sending terminal (FIG. 13) of Embodiment 1

A flow occurring when sharing sending background sound by two portable telephones of Embodiment 2 configured by the sections described above will be summarized by referring to FIG. 1. Message exchange as described in FIG. 12 is performed between the communication controlling sections 28 of both terminals, and a communication channel for sending and receiving background sound is established. After establishing this channel, one operates in a background sound sending mode and the other in a background sound receiving mode. Operations in the respective modes are summarized hereafter.

In a background sound sending mode, the speech sending section 27 outputs data D3 that is speech-encoded voice of a user. In addition, background sound storing section 25 outputs user-selected encoded background sound data D4. D3 and D4 are digital-multiplexed in the multiplexer 23 and outputted as D2. D2 is modulated in the transmission interface section 20 and transmitted.

Moreover, in a background sound sending mode, a received signal is demodulated in the transmission interface section 20, and received data D1 is sent to the demultiplexer 22. In the demultiplexer 22, D1 is outputted as it is, without being processed at all, as encoded speech data D7 and sent to the receiving section 26. In addition, D4 outputted from the background sound storing section 25 is sent to the background sound reproducing section 24 and decoded, and background sound signal D8 is sent to the receiving section 26. Speech-encoded data D7 is decoded and volume-controlled in the receiving section 26, and is further superposed on background sound signal D8 and outputted from a receiver.

As mentioned above, if portable telephones of Embodiment 2 of the present invention are used to send background sound, uttered speech and background sound are separately encoded, multiplexed and sent, so that quality of uttered speech and background sound does not deteriorate. In addition, the background sound to be sent is decoded, adjusted to proper volume and then outputted from a receiver as superposed on received speech, a user can hear the same background sound as the other party. Furthermore, volume of background sound on the other side will not be affected even if the sound is adjusted to desirable volume on a user's own side, so the user can adjust volume without being conscious of a sound environment on the receiving side.

In a background sound receiving mode, data D3 wherein a user's voice is speech-encoded is outputted in speech sending section 27 and sent to multiplexer 23. In multiplexer 23, D3 is outputted as-is, without being processed at all, as encoded speech data D2. D2 is modulated in the transmission interface section 20 and transmitted.

Also, in a background sound receiving mode, a received signal is demodulated in the transmission interface section 20 and received data D1 is sent to the demultiplexer 22. In the demultiplexer 22, received multiplexed data D1 is demultiplexed into received encoded speech data D7 and encoded background sound data D6 and outputted respectively. D6 is sent to the background sound reproducing section 24 and decoded, and background sound signal D8 is sent to the receiver system 26. Received encoded speech data D7 is decoded and volume-controlled in the receiving section 26, and is further superposed on background sound signal D8 and outputted from a receiver.

As mentioned above, a background sound receiving terminal according to Embodiment 2 of the present invention demultiplexes received multiplexed data into received encoded speech data and encoded background sound data so as to decode and adjust volume of received speech and background sound separately. As speech and background sound are decoded separately, quality of received speech and background sound does not deteriorate much. In addition, as volume of speech and background sound can be adjusted separately, the receiving side can adjust volume of background sound as desired according to a surrounding environment. Moreover, in the case where the receiving side does not require background sound, encoded background sound data can be abandoned easily so as to prevent unnecessary output of background sound.

In a portable telephone of Embodiment 1 or Embodiment 2 of the present invention, operations of entering into a controlling mode for sending background sound from a conversation state, selecting background sound, adjusting background sound to desired volume, ending background sound operations, and responding to background sound receiving request from the other terminal can be implemented easily by pressing a button, dialing and so on. The portable telephone of Embodiment 2 of the present invention can display at a glance a current mode (normal mode/controlling mode/background sound sending mode/background sound receiving mode) and current volume setting of background sound. Examples of operations of the portable telephone of Embodiment 2 of the present invention will be described hereafter by referring to FIG. 17 and 18.

Figure 17:
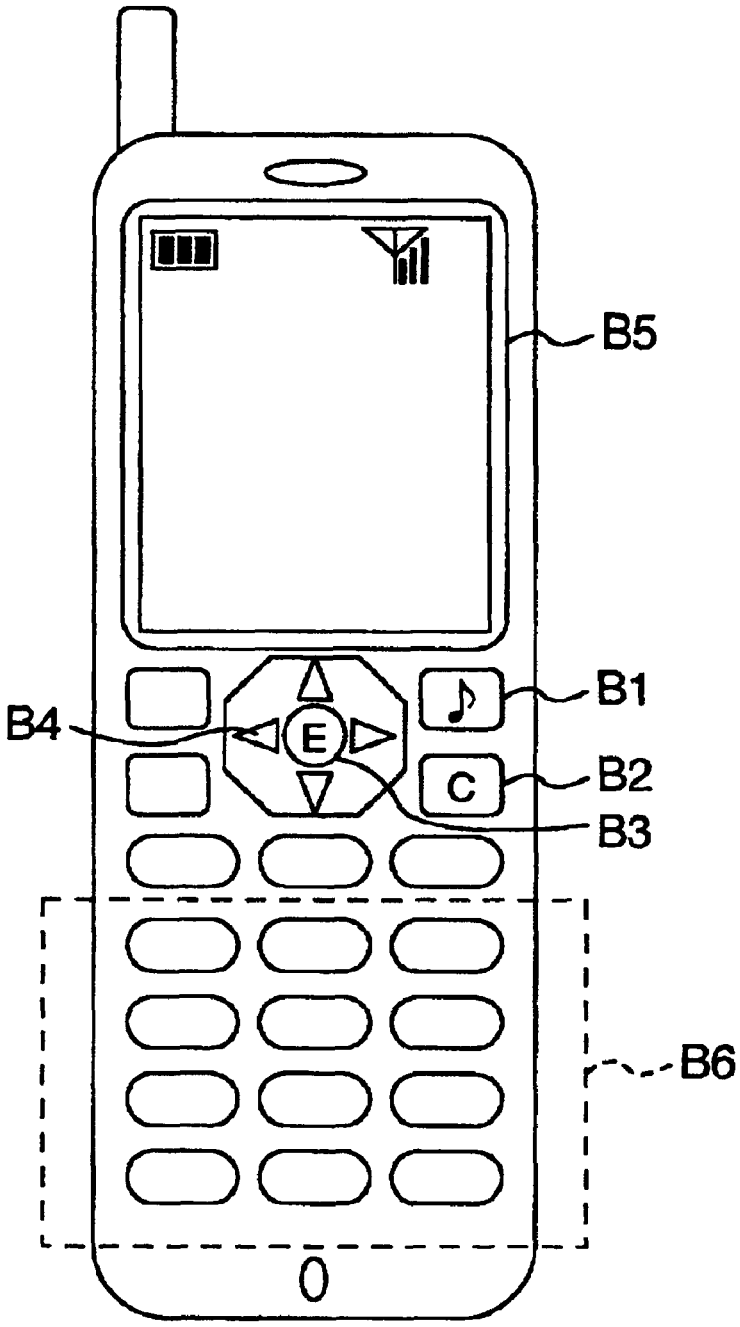
FIG. 17 is an external front view of a portable telephone according to Embodiment 2 of the present invention.
Figure 18:
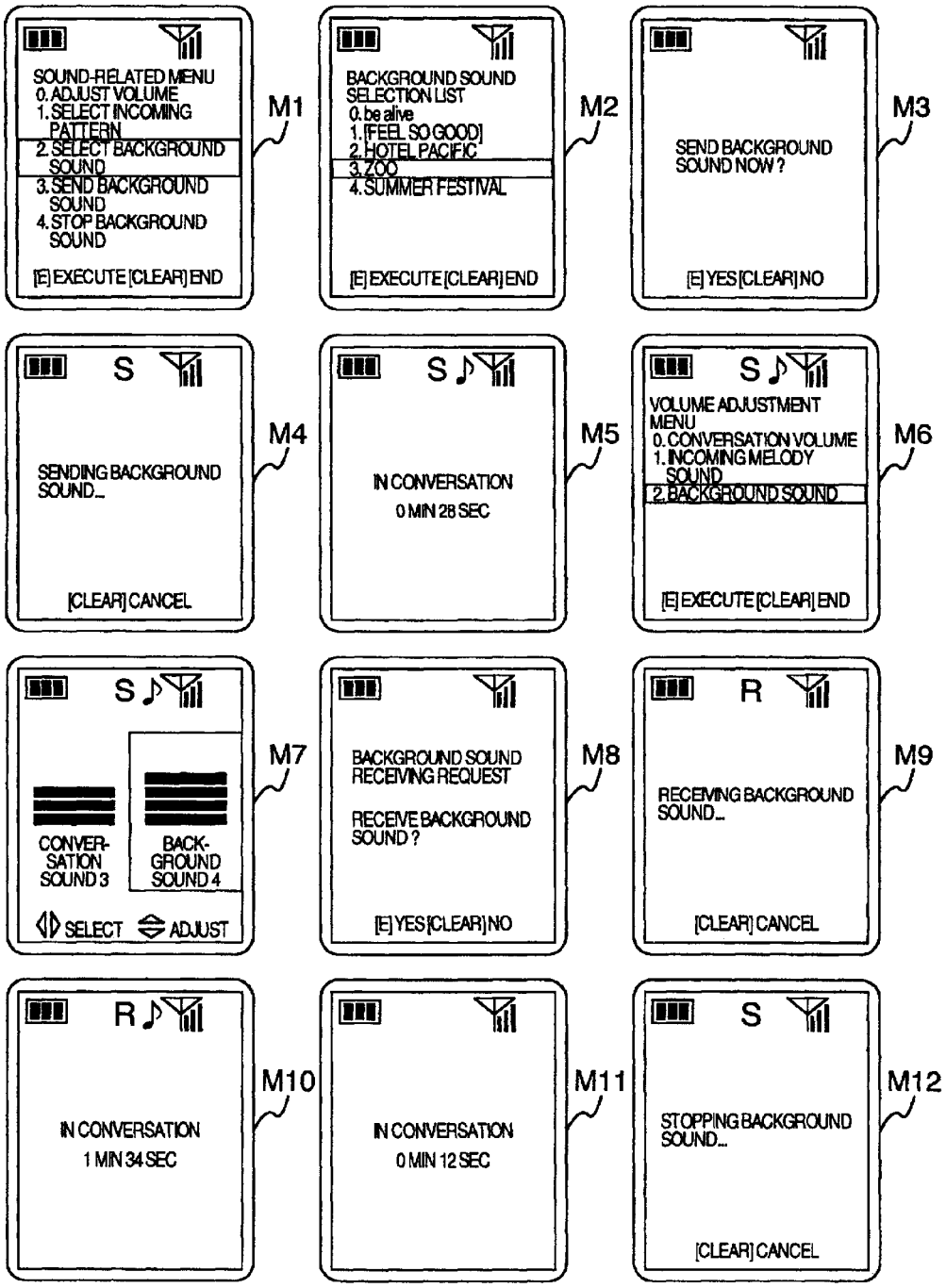
FIG. 18 is a screen view showing examples of screen display of a portable telephone according to Embodiment 2 of the present invention.

FIG. 17 is an external front view of a portable telephone of Embodiment 2 of the present invention. B1 is a sound-related button, B2 is a clear button, B3 is an execute button, B4 is a set of up/down and right/left arrow buttons, B5 is a display section, and B6 is a set of number buttons. FIG. 18 is a drawing showing examples of screens (M1 to M12) of display section B5.

During conversation in a normal mode, screen M11 is displayed. If a sound-related button B1 is pressed in this state, display section B5 displays sound-related menu screen M1. If an item of [Select background sound] is selected out of M1 by pressing number button B6 and arrow button B4 and then execute button B3 is pressed, background sound selection list screen M2 is displayed next. From this list, background sound to be sent is selected by pressing number button B6 and arrow button B4 and then execute button B3 is pressed, background sound is selected and then dialog screen M3 for confirming whether to send the selected background sound is displayed next. If [YES] is selected on M3, it enters into a controlling mode for sending the background sound, and screen M4 is displayed. There is a response from a receiving terminal thereafter, and if message exchange S33 is completed, it automatically enters into a background sound sending mode to display background sound sending mode screen M5 on display section B5 and allow conversation while sharing the background sound. To adjust background sound volume in this state, for instance, sound-related button B1 is pressed to display sound-related menu screen M1 as aforementioned. If an item of [Adjust volume] is selected out of M1 by pressing number button B6 and arrow button B4 and then execute button B3 is pressed, volume adjustment screen M6 is displayed. If [Background sound] is selected out of M6 and execute button B3 is pressed, volume adjustment screen M7 is displayed. M7 displays bar-like drawings in line, which represent stages of volume of conversation sound and background sound. If volume-adjusted sound (conversation sound or background sound) is selected by pressing right/left arrow button B4 and then if length of the bar is adjusted by pressing up/down arrow button of B4, volume of the selected sound is adjusted according to the length of the bar. In the case where background sound needs to be stopped during conversation in a background sound sending mode, sound-related button B1 is pressed to display sound-related menu screen M1 as aforementioned. If an item of [Stop background sound] is selected out of M1 by pressing number button B6 and arrow button B4 and then execute button B3 is pressed, message exchange (S35, S36) for stopping background sound is performed, and then screen M12 is displayed. If the above described message exchange (S35, S36) is completed, transmission of background sound is stopped and it returns to a normal mode to display screen M11.

On the other hand, in the case where, during conversation in a normal mode (a state in which screen M11 is displayed), the other party requests receiving of background sound by performing the aforementioned background sound sending operation, display section B5 on the background sound receiving side displays message screen M8. M8 prompts a user to determine whether or not to accept the background sound receiving request. If [YES] is selected on M8 to accept the background sound receiving request, it enters a controlling mode for receiving the background sound, and screen M9 is displayed. If message exchange S33 in the controlling mode is completed thereafter, it enters a background sound receiving mode, and background sound receiving mode screen M10 is displayed on display section B5.

Embodiment 3 of the present invention is a portable telephone capable of sending and receiving three or more types of encoded speech data or encoded audio data. Embodiment 3 can be implemented, as a deformed example of Embodiment 1 or Embodiment 2, by adding three or more types of speech/audio codec and multiplexing and demultiplexing three or more types of logical channel.

Embodiment 4 of the present invention is a portable telephone, as a deformed example of Embodiment 1 or Embodiment 2, having a function of receiving background sound to which means for storing received encoded background sound data in internal or external memory and so on is added. A copyright protection mechanism can be added to this Embodiment.

Embodiment 5 of the present invention is a portable telephone, as a deformed example of Embodiment 2, in which positions of DA converters in the background sound reproducing section 24 and receiving section 26, an AD converter in speech sending section 25 and amplifying circuits of the sections are exchanged. In Embodiment 5, each of the amplifying circuits has a function of controlling quantized values of PCM (Pulse Code Modulation) data.

Embodiment 6 of the present invention is a different multiplexing method adopted for the multiplexing method in the multiplexer 23 (or the multiplexer 23*a*) and the demultiplexer 22 (or 22*a*), as a deformed example of Embodiment 1 or Embodiment 2. For instance, H. 223 Annex A/B/C/D with enhanced error resilience can be used as a multiplexing method.

Moreover, an Embodiment form of the present invention can be a communication apparatus other than a portable telephone, such as a wire telephone, a transceiver or a wireless LAN.

According to the present invention, uttered encoded speech data and encoded background sound data are digital-multiplexed and sent and received, so that deterioration of quality of conversation speech and background sound is alleviated and conversation in better atmosphere can be enjoyed. In addition, as volume of conversation speech and background sound can be adjusted separately on both the sending and receiving sides, both sides can adjust volume of background sound to a desired level without being conscious of a surrounding environment on the other side. Moreover, in the case where the receiving side does not require background sound, background sound data can be abandoned easily so as to prevent output of unnecessary background sound. Furthermore, the background sound sending side can determine in advance whether the other terminal has a function of demultiplexing speech data of multiplexed background sound, so it is possible, in the case where the receiving side terminal does not have the above described function, to prevent a problem of sending speech data with multiplexed background sound and breaking down conversation. Thus, the present invention can implement superior tone and operability in a communication apparatus for sharing background sound compared with conventional technologies so as to provide a user with a previously unknown pleasant conversation environment.

What is claimed is:

1. A communication apparatus, comprising:

a speech sending section for encoding inputted speech and outputting encoded speech data;

a background sound storing section for outputting encoded background sound data in which background sound is encoded;

a multiplexer for digital-multiplexing said encoded speech data and said encoded background sound data and outputting multiplexed data; and a transmission interface section for outputting the above multiplexed data to a transmission line;

wherein it is determined whether the other apparatus has a function of decoding speech and background sound separately; and in the case of determining that there is not provided said function, said encoded background sound data is decoded and added to said speech, and then is speech-encoded in said speech sending section and is outputted from said transmission interface section to a transmission line.

2. The communication apparatus according to claim 1, further comprising:

a background sound reproducing section for decoding said encoded background sound data and outputting a background sound reproducing signal; and a receiving section for decoding encoded speech data received in said transmission interface section and superposing decoded data on said background sound reproducing signal to output superposed data to a receiver.

3. The communication apparatus according to claim 1, wherein the above background sound storing section holds a plurality of background sound and outputs encoded background sound data of background sound selected by a user.

4. A communication apparatus according to claim 1, comprising:

a demultiplexer for demultiplexing received multiplexed data including speech data and background sound data to provide encoded speech data and second encoded background sound data;

a background sound reproducing section including a switch section which inputs said encoded background sound data stored in a background sound storing section and said second encoded background sound data and selects one data thereof based on a control signal, said background sound reproducing section decoding and outputting said one data selected in said switch section; and a receiving section for decoding said encoded speech data and superposing said encoded speech data decoded on said one data thereby to output superposed data to a receiver for a user, wherein said background sound reproducing section includes an amplifying circuit for controlling amplification gain of said one data.

5. The communication apparatus according to claim 4, wherein said encoded background sound data stored in said storing section is abandoned according to an instruction by said user not to reproduce background sound.

6. The communication apparatus according to claim 5, wherein a signal requesting not to send background sound to the other party's communication apparatus is outputted to a transmission line.

7. The communication apparatus according to claim 4, wherein a signal requesting not to send background sound to the other party's communication apparatus is outputted to a transmission line.

8. A communication apparatus according to claim 4, wherein said control signal indicates a receiving mode form said communication apparatus.

9. A communication apparatus, comprising:

a transmission interface section for inputting and outputting multiplexed data to a transmission line;

a first communication device connected to said transmission interface section and comprising:

a first speech sending section for speech-encoding inputted speech and outputting encoded speech data;

a first background sound storing section for outputting encoded background sound data wherein background sound is encoded;

a first multiplexer for digital-multiplexing said encoded speech data and encoded background sound data and outputting multiplexed data to said transmission line;

a first demultiplexer for demultiplexing multiplexed data received in said transmission interface section and outputting encoded speech data and encoded background sound data;

a first background sound reproducing section for decoding said encoded background sound data and outputting a background sound reproducing signal; and a first receiving section for decoding said encoded speech data and superposing decoded data on said background sound reproducing signal to output superposed data to a receiver; and a second communication device connected to said transmission interface section and comprising:

a second speech sending section for speech-encoding inputted speech and outputting encoded speech data;

a second demultiplexer for demultiplexing multiplexed data received in said transmission interface section and outputting encoded speech data and encoded background sound data;

a second background sound reproducing section for decoding said encoded background sound data and outputting a background sound reproducing signal; and a second receiving section for decoding said encoded speech data and superposing decoded data on said background sound reproducing signal to output superposed data to a receiver;

wherein it is determined whether the second communication device has a function of decoding speech and background sound separately; and in the case of determining that there is not provided said function, said encoded background sound data is decoded and added to said speech, and then is speech-encoded in said speech sending section and is outputted from said first communication device via said transmission interface section to a transmission line; and wherein a decoding signal of said encoded speech data and an output speech of said background sound reproducing signal are separately volume-controlled.

10. The communication apparatus according to claim 9, a signal requesting said first communication device not to send background sound data is outputted from said first communication device via said transmission line.

11. A communication apparatus, comprising:

a transmission interface section for inputting and outputting multiplexed data to a transmission line;

a first communication device connected to said transmission interface section and comprising:

a first speech sending section for speech-encoding inputted speech and outputting encoded speech data;

a first background sound storing section for outputting encoded background sound data wherein background sound is encoded;

a first multiplexer for digital-multiplexing said encoded speech data and encoded background sound data and outputting multiplexed data to said transmission line;

a first demultiplexer for demultiplexing multiplexed data received in said transmission interface section and outputting encoded speech data and encoded background sound data;

a first background sound reproducing section for decoding said encoded background sound data and outputting a background sound reproducing signal; and a first receiving section for decoding said encoded speech data and superposing decoded data on said background sound reproducing signal to output superposed data to a receiver, and a second communication device connected to said transmission interface section and comprising:

a second speech sending section for speech-encoding inputted speech and outputting encoded speech data;

a second demultiplexer for demultiplexing multiplexed data received in said transmission interface section and outputting encoded speech data and encoded background sound data;

a second background sound reproducing section for decoding said encoded background sound data and outputting a background sound reproducing signal; and a second receiving section for decoding said encoded speech data and superposing decoded data on said background sound reproducing signal to output superposed data to a receiver;

wherein it is determined whether the second communication device has a function of decoding speech and background sound separately; and in the case of determining that there is not provided said function, said encoded background sound data is decoded and added to said speech, and then is speech-encoded in said speech sending section and is outputted from said first communication device via said transmission interface section to a transmission line.

* * * * *